US005927420A

United States Patent [19]

Karrington

[11] Patent Number: 5,927,420

[45] **Date of Patent: *Jul. 27, 1999**

[54] ENGINE DRIVEN SKATEBOARD

[76] Inventor: Blake S. Karrington, 1346 E. 1700 South, Salt Lake City, Utah 84105

[ * ] Notice: This patent issued on a continued prosecution application filed under 37 CFR 1.53(d), and is subject to the twenty year patent term provisions of 35 U.S.C. 154(a)(2).

[21] Appl. No.: 08/622,733

[22] Filed: Mar. 27, 1996

[51] Int. Cl.[6] ..... A63C 5/08

[52] U.S. Cl. ..... 180/181; 280/87.042

[58] Field of Search ..... 180/180, 181, 180/65.6, 65.1, 65.5; 280/87.041, 87.042

[56] References Cited

U.S. PATENT DOCUMENTS

| | | | |
|---|---|---|---|
| 4,069,881 | 1/1978 | Shiber . | |
| 4,073,356 | 2/1978 | Schlicht . | |
| 4,094,372 | 6/1978 | Notter . | |
| 4,143,728 | 3/1979 | Shiber . | |
| 4,151,892 | 5/1979 | Francken . | |
| 4,183,546 | 1/1980 | Heilig | 280/87.042 |
| 4,274,647 | 6/1981 | Drake, Jr. . | |
| 5,020,621 | 6/1991 | Martin | 180/181 |
| 5,090,716 | 2/1992 | Borden | 280/87.042 |
| 5,127,488 | 7/1992 | Shanahan | 180/181 |
| 5,305,846 | 4/1994 | Martin | 180/181 |
| 5,487,441 | 1/1996 | Endo et al. | 180/181 |

*Primary Examiner*—Richard M. Camby
*Attorney, Agent, or Firm*—Thorpe, North & Western, L.L.P.

[57] ABSTRACT

An engine driven skateboard, with an engine assembly attached to the platform, allowing for propelling the skateboard while maintaining conventional means for riding and controlling the skateboard. The engine driven skateboard includes a platform upon which the rider stands, at least one front wheel rotatably mounted underneath the front end section of the platform and at least one wheel rotatably mounted underneath the back end section of the platform. A drive wheel is rotatably attached to the engine, with a force transfer means for transferring force from the engine to the drive wheel so as to cause the drive wheel to rotate. The engine and drive wheel are fixedly attached to the platform, closer to either the front end section or back end section of the platform than to the center of the platform. The engine and drive wheel may be attached so that the drive wheel is positioned in front of or behind the front or back wheels. The invention further teaches a rigid throttle control means for controlling the engine drive system of an engine driven skateboard and a force absorption means between the rider's platform and the engine drive system to enhance the stability and steerability of the skateboard.

17 Claims, 6 Drawing Sheets

ENGINE DRIVEN SKATEBOARD

BACKGROUND OF THE INVENTION

1. Field of the Invention

The invention herein pertains generally to the field of engine powered skateboards.

2. The Background Art

Skateboards are normally built with front and back wheels rotatably mounted to a platform. To gain momentum, the skateboard rider stands on the platform with one foot and propels the skateboard by placing the other foot on the ground and pushing. The rider stops the skateboard either by dragging a foot or with the pivot-and-drag method. The pivot-and-drag method is executed by pivoting the platform on either the front or rear wheels so that the opposite wheels lift off the ground. This pivoting causes the end of the platform nearest the wheels that remain on the ground to drag on the ground, stopping the skateboard through frictional drag. The pivoting technique is further used to engage in small radius turns and twirling maneuvers. A skateboard rider may gain additional momentum by riding the skateboard downhill or by being towed by another vehicle.

The common methods for gaining additional momentum have inherent problems and dangers. Hills compatible with the use of a skateboard are not always available. When they are the rider desiring to skateboard down the hill again must return to the top after reaching the bottom. The dangers and limitations of being towed by another vehicle are also significant, especially if the skateboard rider is towed by an automobile.

To solve these problems, it has been desirable to attach a motor or an engine to the skateboard which the driver can control. A number of different approaches have been made with varying degrees of limited success. The usual approach in the art has been to attach an engine or motor to the skateboard coupled to one or both of the back wheels. This approach requires that the skateboard undergo substantial alteration of the skateboard's back wheels or platform. Additional problems arise under this approach with regard to the steerability and stability of the skateboard, as the dynamics for turning, stopping, and balance of the skateboard are substantially altered or limited when one or more of the back wheels are coupled to an engine.

Another approach, as seen in U.S. Pat. No. 4,073,356, has been to elongate the platform of the skateboard, open a hole in the center of the platform, and attach a fifth wheel to the platform; with the fifth wheel extending through the platform to where it is coupled to a motor. This approach has a number of limitations, including: the rider is required to straddle the motor and drive wheel; the traction of the fifth wheel depends upon the unnatural shifting of the weight distribution of the person on the skateboard; a specialized elongated skateboard construction is required to attach the motor and fifth wheel to the skateboard; and, the engine and drive wheel being mounted equidistant from the front and back wheels for the cantilever effect of the flexible platform makes the skateboard difficult to stop in the pivot-and-drag method of skateboard riders because the engine and wheel assembly must be lifted into the air.

Vibrations to the engine and drive wheel assembly have been an additional source of problems for engine or motor driven skateboards. The vibrations caused by the engine and the vibrations, shocks, and bumps transmitted from the ground through the driven wheel to the engine cause instability in engine or motor driven skateboards. This instability problem has not been previously addressed with regard to skateboards. No force absorption means is taught in the prior art with regard to engine or motor driven skateboards.

To compensate for the instability of engine or motor driven skateboards, the prior art teaches a number of different throttle controls using flexible cables or wires. The belief has been that the hands had to be used as "counter weights" which the skateboard rider was required to throw upwards and sideways to maintain balance on the skateboard. So, the effort has been to make the controls increasingly flexible in order to allow the hands to flail around.

OBJECTS AND SUMMARY OF THE INVENTION

It is therefore an object of the present invention to provide an engine driven skateboard, which is easier and safer to use.

It is another object of the invention, in accordance with one aspect thereof, to provide such a skateboard having a rigid throttle control means, which is more accessible and easier to use.

It is an additional object of the invention, in accordance with one aspect thereof, to provide a skateboard having enhanced stability and steerability.

While the present invention is described in terms of an engine driven skateboard, it is to be understood that the subject apparatus and method may be used in any field of motorized platform vehicle application. Those having ordinary skill in the field of this invention will appreciate the advantages of the invention, and its application to a wide variety of platform vehicle uses.

It is to be understood that the words "drive" and "driven" are used in a broad sense meaning to propel by pushing or pulling.

The above objects and others not specifically recited are realized in a specific illustrative embodiment of an engine driven skateboard for propelling a skateboard and other platform vehicles.

The engine driven skateboard includes a skateboard having a platform upon which the rider stands. The platform has at least one front wheel rotatably mounted underneath the front end of the platform and at least one back wheel rotatably mounted underneath the back end of the platform. The center of the platform is located equidistant from the front wheels and the back wheels. A drive wheel is rotatably attached to the engine, with a force transfer means for transferring force from the engine to the drive wheel so as to cause the drive wheel to rotate. The force transfer means preferably includes, but is not limited to, chains and sprockets, belts and pulleys, or cam shafts. The engine and drive wheel are fixedly attached to the platform. The attachment means for attaching the engine and drive wheel to the platform can be, but is not limited to, brackets, bolts, clasps, or rails. The engine and drive wheel are attached closer to either the front end or back end of the platform than to the center of the platform. The engine and drive wheel are attached so that the drive wheel may be positioned in front of or behind the front or back wheels.

A force absorbing means used to attach the engine and drive wheel to the platform is also an object of the invention. The shock absorbing means can be, but is not limited to, spacers, springs, or grommets. The force absorbing means reduces instability of the skateboard through absorbing engine vibrations due to the operation of the engine, and further reduces instability by reducing the effect of road surface.

A rigid control means for varying the force transferred from said engine to said drive wheel is also an object of the invention. In use, the rigid control provides the rider greater stability and steerability of the engine driven skateboard. The rigid control provides the rider control over the force transferred from the engine. Also, because the control is rigid, the rider can control the stability and position of the skateboard without relying completely on balance.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
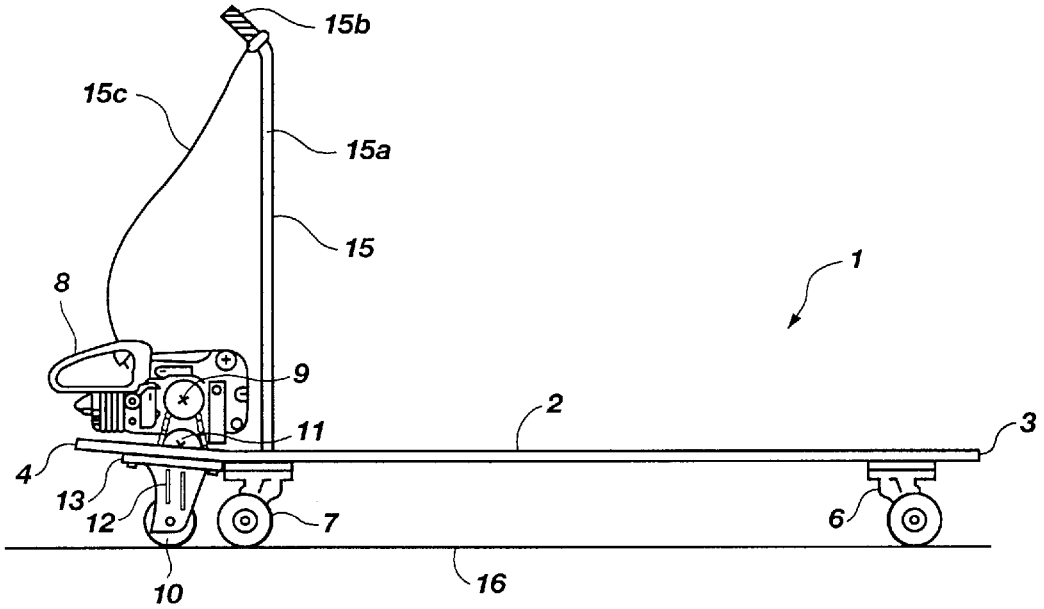
FIG. 1 is a side view of an engine driven skateboard made in accordance with the principals of the present invention.

Referring to FIGS. 1–4, and 7 there is shown an engine driven skateboard, generally designated at 1. FIG. 1 shows engine driven skateboard 1, which comprises a platform 2, at least one front wheel 6, at least one back wheel 7, and an engine assembly 8.

The platform 2 has a front end section 3, a back end section 4, and a center 5 and a longitudinal centerline 14. The elements of "front end section 3", and "back end section 4" refer generally to length wise end portions of the platform 2, such as for example, the front one-third of the platform and the back one-third of the platform, respectfully. Rotationally mounted underneath the front end section 3 is at least one front wheel 6 and rotationally mounted underneath the back end section 4 is at least one back wheel 7. Preferably, two front wheels 6 and two back wheels 7 are provided, as shown.

Figure 2:
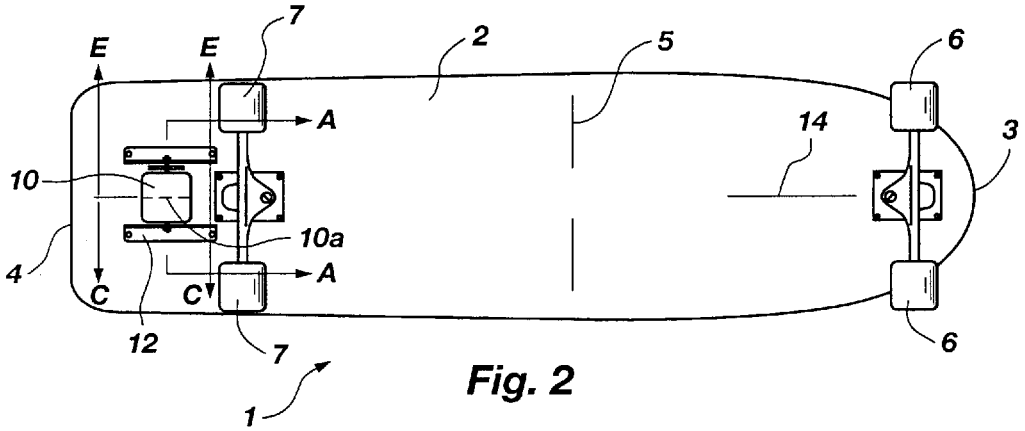
FIG. 2 is a bottom view the skateboard of FIG. 1.
Figure 3:
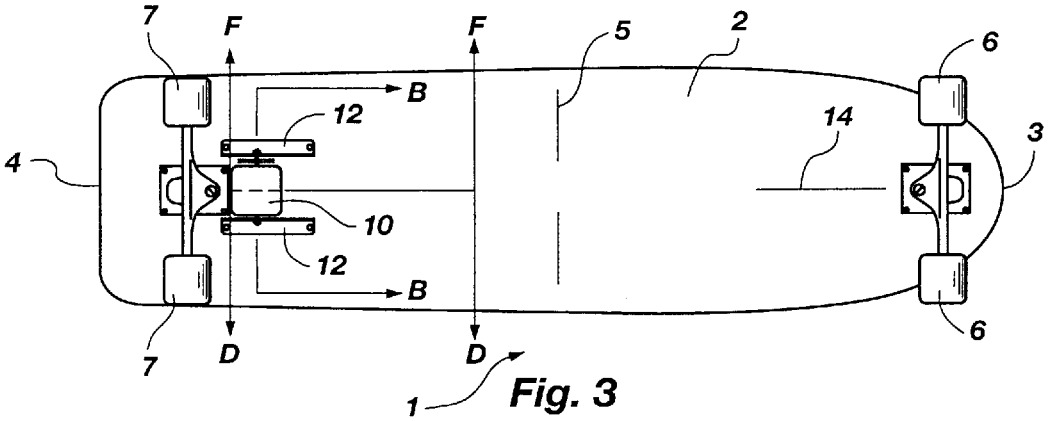
FIG. 3 is a bottom view of an alternative embodiment of the skateboard of FIGS. 1–2, with the drive wheel disposed on the other side of the back wheels.

FIGS. 2 and 3 show the longitudinal centerline 14, which defines a long axis of the platform 2 extending from the front end section 3 to the back end section 4 of the platform 2. FIGS. 2 and 3 further show the center 5 which is the axis equidistant from the front wheel 6 and the back wheel 7.

Figure 6:
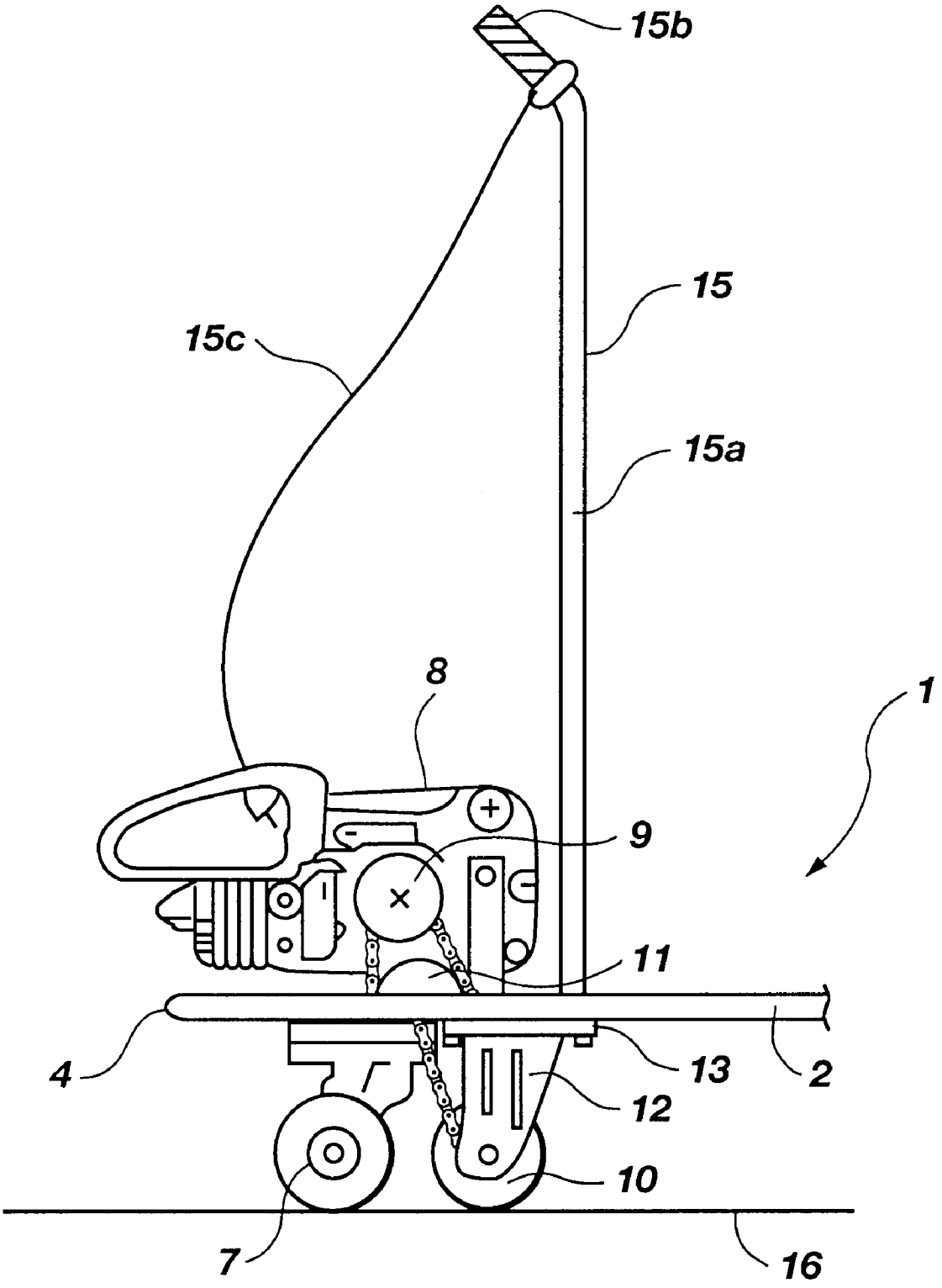
FIG. 6 is a side view of FIG. 3.
Figure 7:
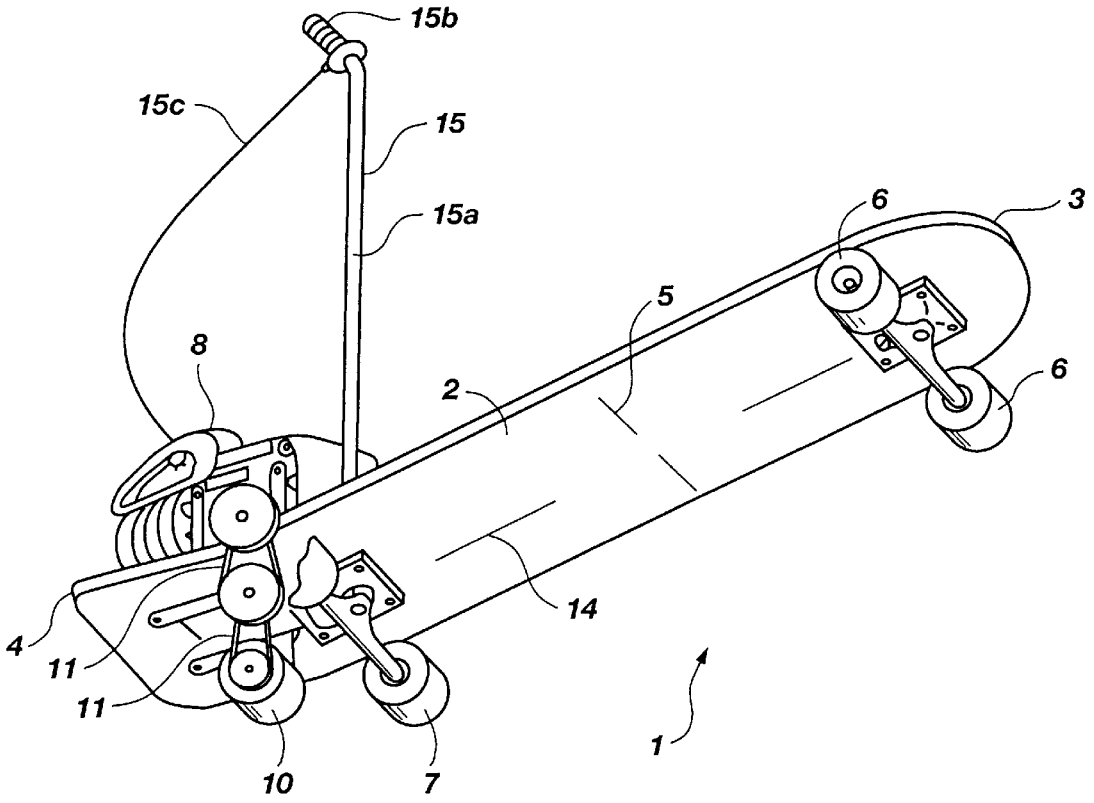
FIG. 7 is a rear, perspective view or the skateboard of FIG. 1, with force transfer means shown as a break-away view.

The engine assembly, generally designated at 8 is attached to the platform 5 by an attachment means 12. The engine assembly comprises an engine 9, a drive wheel 10, and a force transfer means 11. FIG. 6 shows the engine assembly 8 attached to the platform with the attachment means 12 represented by a bracket. The force transfer means 11, shown in FIGS. 6 and 7, may comprise a system of chains and sprockets or belts and pulleys.

Figure 4:
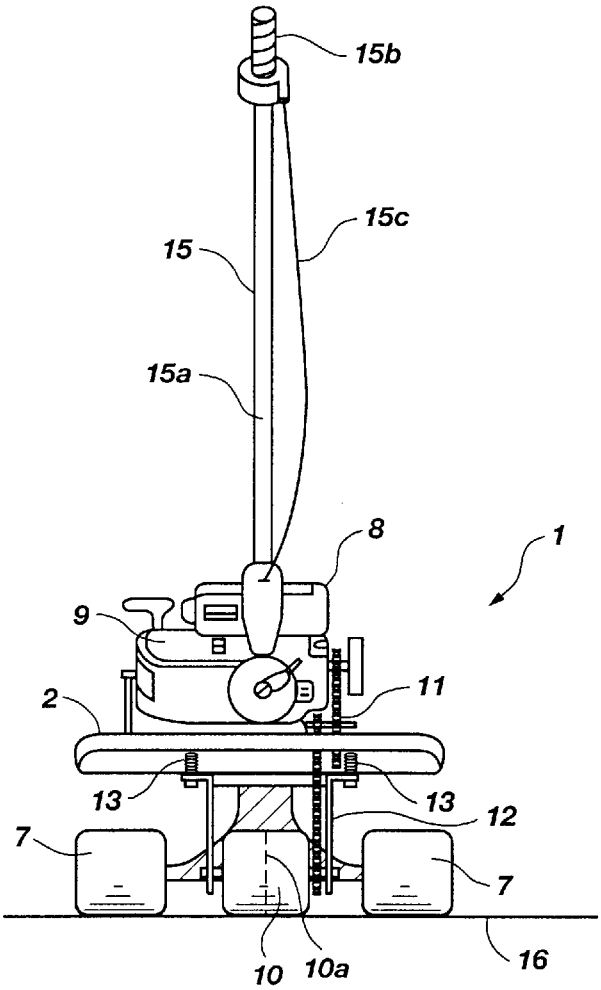
FIG. 4 is a rear view of the skateboard of FIG. 1.
Figure 5:
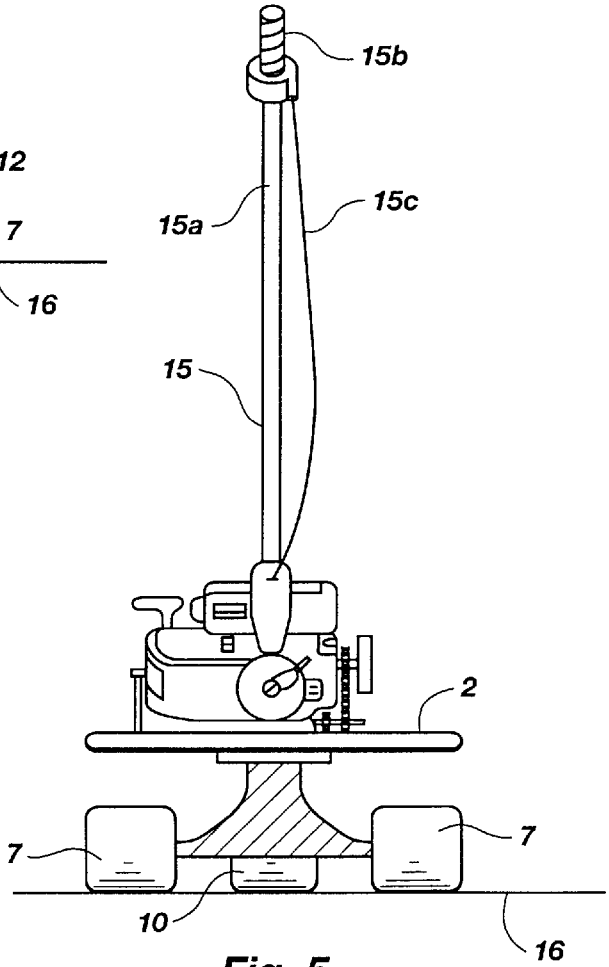
FIG. 5 is a rear view of the alternative embodiment of the skateboard of FIG. 3.

FIGS. 2 and 3 show the drive wheel 10 located on either side of the back wheel 7. FIGS. 4 and 5 also show the drive wheel 10 located on either side of the back wheel 7. The drive wheel 10 can also be located on either side of the front wheel 6, not shown. As shown in FIGS. 2 and 3, the drive wheel 10 is located closer to an end section 3 and 4 than to the center 5 of said platform 2. FIGS. 2 and 3 further show the drive wheel 10 near the longitudinal centerline 14 of the platform 2.

Figure 8:
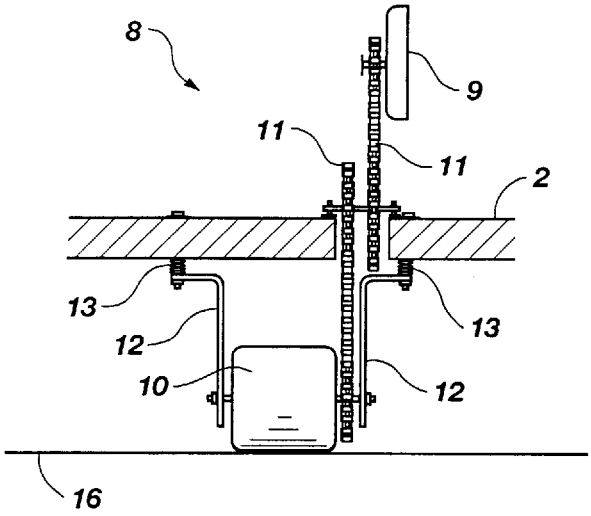
FIG. 8 is a cross-sectional view taken along section A—A of FIG. 2, OR section B—B of FIG. 3., the two sections being identical.
Figure 9:
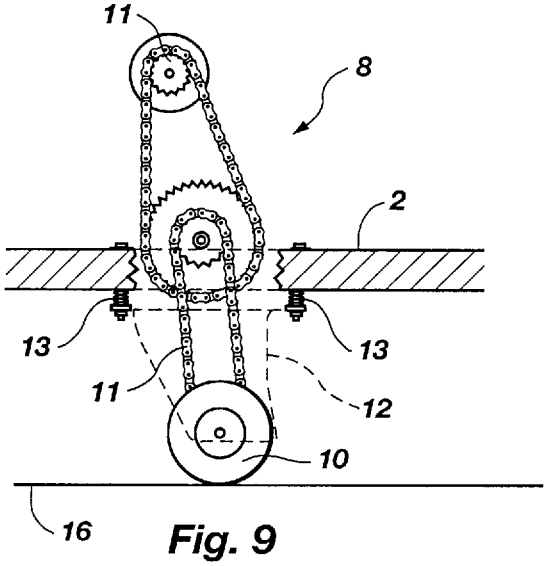
FIG. 9 is a cross-sectional view taken along section C—C of FIG. 2 or along section D—D of FIG. 3, the two sections being identical.
Figure 10:
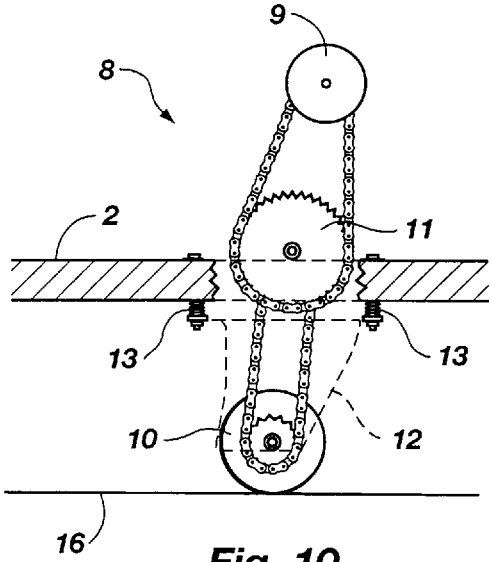
FIG. 10 is a cross-sectional view taken along section E—E of FIG. 2 or along section F—F of FIG. 3, the two sections being identical.

A preferred embodiment of the invention, shown in FIGS. 8–11, includes the force transfer means 11 being comprised of chains and sprockets. FIGS. 9 and 10 are partially schematic views of the engine assembly 8 along section line C—C and E—E shown in FIG. 2, or section E—E and FF shown in FIG. 3, which are functionally equivalent section lines. FIG. 8 is partially schematic view of the engine assembly 8 along section line A—A shown in FIG. 2, or section B—B shown in FIG. 3, which are functionally equivalent section lines. The preferred embodiment shows where the force transfer means 11 of chains and sprockets connects the engine 9 to the drive wheel 10.

Figure 11:
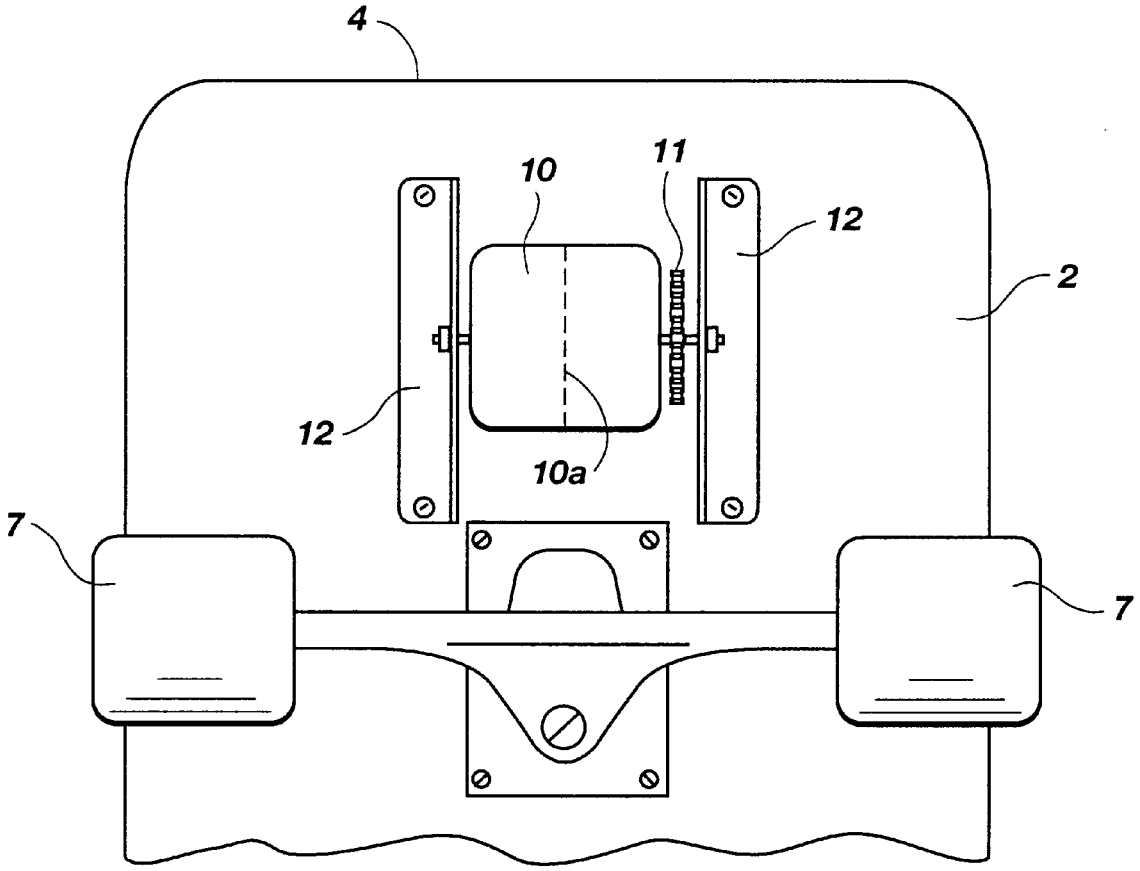
FIG. 11 is an enlarged, partial bottom view of the skateboard of FIG. 2.

The engine assembly 8 is attached to the platform 2 using the attachment means 12, wherein the attachment means 12 comprise a force absorption means 13. A preferred embodiment, also shown in FIGS. 4, 6, and 8–10 shows the attachment means 12 comprising brackets and the absorption means 13 shown as rubber spacers. The brackets and spacers of the attachment means 12 in the preferred embodiment are attached on both sides of the drive wheel, as seen in FIGS. 4, 8 and 11.

A preferred embodiment of the invention, shown in FIGS. 1, 6, and 8–10 is with the drive wheel 10 being of a diameter equal to or less than the distance between the platform 2 and the ground 16 when said skateboard 1 is placed on the ground 16 with said front wheels 6 and back wheels 7 in a downward direction and touching the ground 16.

FIGS. 1 and 4–7 show a rigid control means 15 to vary the force transferred by the force transfer means 11 from the engine 9 to the drive wheel 10. A preferred embodiment of the invention, shown in FIG. 6 is with the rigid control means 15 attached to the platform 2 near the engine assembly 8, the rigid control means 15 comprising a support bar 15*a* to which is attached a twist action handle 15*b* from which an electrical cable 15*c* runs from the handle to engine assembly 8, thus allowing the skateboard rider to vary the force transferred by the force transfer means 11. The bar 15*a* is preferably hollow and substantially nonflexible or rigid.

The engine assembly 8 and the force transfer means 11 cooperatively comprise a suitable power means or driving means, coupled to the platform 2 for transmitting force to the drive wheel 10 responsive to control signals produced by the control means 15 to thereby cause the drive wheel 10 to rotate at speeds dependent upon the control signals. The control signals are produced by twisting the twist action handle 15*b*, which includes means responsive to the twisting for producing the control signals, which are then transmitted through the electrical cable 15*c* to the engine assembly 8, as understood by those of ordinary skill in the art. The electrical cable 15*c* thus operates as a suitable electrical transmitting means electrically coupled to the engine assembly 8, so that the entire control means 15 is configured for producing control signals of varying magnitude responsive to the degree of twist of the twist handle 15*b* and transmitting the control signals to the engine assembly 8 to thereby vary the force transmitted to the drive wheel 10.

The support bar 15*a* is coupled to the platform 2 and to the cable 15*c* for supporting the cable at a location above the platform 2. As shown in the figures, the cable 15*c* extends directly from the twist action handle 15*b* to the engine assembly 8 and does not pass through any portion of the support bar 15*a*. In the alternative, however, the support bar 15*a* can be hollow and the cable 15*c* may pass from the handle 15*b* through the bar 15*a* before attaching to the engine assembly 8.

The drive wheel 10 includes a center line 10*a* which is preferably disposed in substantial vertical alignment with the longitudinal center line 14 of the platform 2. In addition, the engine assembly 8 includes a center of gravity which is also preferably disposed in substantial vertical alignment with the longitudinal center line 14 of the platform 2.

The present invention represents a significant advance over the prior apparatus, methods and art of engine or motor driven skateboards. It is noted that many of the advantages of the present invention accrue due to the attachment of the engine assembly, force transfer means and drive wheel to a platform, wherein the platform does not require any specific standards for rigidity or flexibility and the wheels of the skateboard do not require any alteration, reconstruction, or change.

Although the prior art apparatus and methods for engine driven skateboards have attached engines to skateboards, they have utilized the back wheels of the skateboard as the drive wheel. As a result, the turning speeds and radius and stability of the such skateboards have been undesirable, primarily due to the different tangential speeds of the back wheels. Attempts to adjust for the differing tangential speeds of the driven wheel with respect to the other back wheel through use of automotive type differentials have met with varying success. Nonetheless, wherever the back wheel is used as a drive wheel significant reconstruction of the back wheel is required, and often the back wheel attachment must also be changed. The present invention significantly increases the stability and steerability of an engine driven skateboard, as the drive wheel is not one of the back wheels or front wheels of the skateboard. Furthermore, the present invention does not require a change in any manner of back wheels or the front wheels of the skateboard.

Attempts to attach a drive wheel in addition to the front wheels and back wheels have been unsuccessful because the platform had to be modified to accommodate the additional wheel and the platform had to be specialized to meet particular flexibility standards. The placement of the engine and fifth wheel in the prior art required the skateboard be operated in a manner significantly different from skateboards without engines; specifically requiring the rider to shift position in the operation of the drive wheel. The problems in the prior art are overcome by the present invention, which does not require any significant modification in either the platform or the manner in which the skateboard is operated.

Further advantage comes from the absorption, through the use of the absorption means, of impulse forces, including vibrations, shocks, bumps, and impacts. Not only are the vibrations of the engine absorbed by the absorption means, but those impulse forces which arise from the ground conditions as the skateboard is ridden are also absorbed. This represents a significant improvement over the prior art where nothing is taught regarding absorption of impulse forces, and where impulse forces have a substantial role to play with regard to the stability of an engine or motor driven skateboard.

The problems of stability and steerability are overcome by the rigid control means, which contrary to the prior art which teaches a flexible control means, teaches improved stability and steerability of an engine and motor driven skateboard. An added advantage offered by the present invention is the ability to directly control the skateboard's position with the rigid control means, so as to enable the rider to stabilize the platform without relying solely on his or her flailing arms as counterweights.

Those skilled in the art will appreciate from the preceding disclosure that the objectives stated above are advantageously achieved by the present invention.

It is to be understood that the above-described arrangements are only illustrative of the application of the principles of the invention. Numerous modifications and alternative arrangements may be devised by those skilled in the art without departing from the spirit and scope of the present invention and the appended claims are intended to cover such modifications and arrangements.

What is claimed is:

1. A skateboard comprising:

a one piece platform configured to support a rider thereon, said platform having a front end section, a back end section, and a central section;

at least one front wheel rotatably mounted beneath the front end section of said platform;

at least one back wheel rotatably mounted beneath the back end section of said platform;

a drive wheel rotatably mounted to and beneath the platform at an end section thereof, said drive wheel being positioned adjacent one of said at least one front wheel and said at least one back wheel to contact a surface on which the skateboard is placed;

power means fixedly mounted onto the platform and responsive to control signals for causing the drive wheel to rotate at speeds dependant upon the control signals; and manually manipulable control means for manipulation by a rider to produce control signals for transmittal to the power means.

2. The skateboard as in claim 1, further comprising:

a force absorbing means coupled to the drive wheel for absorbing forces.

3. The skateboard as in claim 1, wherein the control means comprises a rigid support bar.

4. The skateboard as in claim 1, wherein said drive wheel is of substantially the same size, dimension, and material as said front wheel or said back wheel.

5. The skateboard as in claim 1, wherein the platform has a longitudinal centerline, and the drive wheel has a centerline, said centerline of the drive wheel being disposed substantially in vertical alignment with the longitudinal centerline of said platform.

6. The skateboard as in claim 1, wherein the platform has a longitudinal centerline and the power means has a center of gravity which is disposed substantially in vertical alignment with the longitudinal centerline of said platform.

7. The skateboard as in claim 1, wherein said drive wheel has a diameter less than the distance between the platform and the ground when the front and back wheels are placed upon the ground.

8. The skateboard as in claim 1, wherein said platform is substantially rigid.

9. The skateboard as in claim 1, wherein the control means comprises an elongated support bar coupled to the platform and extending upwardly therefrom.

10. The skateboard as in claim 1, wherein said control means comprises a twist action handle having means responsive to twisting of said handle for producing said control signals.

11. A skateboard comprising:

a one piece platform configured to support a rider, said platform having a front end section and a back end section;

a pair of laterally spaced front wheels rotatably mounted beneath the front end section of said platform;

a pair of laterally spaced back wheels rotatably mounted beneath the back end section of said platform;

a drive wheel rotatably mounted to and beneath the platform adjacent one of said pair of laterally spaced front wheels and said pair of laterally spaced back wheels;

driving means coupled to the platform for transmitting force to the drive wheel responsive to control signals to thereby cause said drive wheel to rotate;

manually manipulable control means producing control signals to the driving means thereby responsively varying the force transmitted by the driving means to drive wheel;

said control means further comprising a substantially rigid support bar coupled to the platform.

12. The skateboard as in claim 11, wherein said control means is of sufficient length to extend from the hand of a rider standing on said platform to the driving means.

13. The skateboard as in claim 11, further comprising:

a force absorbing means coupled to the drive wheel for absorbing forces transmitted through the drive wheel.

14. The skateboard as in claim 11, wherein the drive wheel is positioned closer to an end section than to said center of said platform.

15. The skateboard as in claim 11, wherein said platform is substantially rigid.

16. The skateboard as in claim 11, wherein said substantially rigid support bar comprises an elongated hollow member coupled to the platform and extending upwardly therefrom.

17. The skateboard of claim 1, wherein said drive wheel is positioned between said at least one front wheel and said at least one back wheel adjacent said at least one back wheel.

* * * * *